United States Patent [19]

Funahashi

[11] 4,119,030

[45] Oct. 10, 1978

[54] ENDLESS PRINTING BELT FOR ROTARY RUBBER STAMP

[76] Inventor: Takaji Funahashi, No. 1, 2-chome, Kitatakasho-machi, Nishi-ku, Nagoya-shi, Aichi-ken, Japan

[21] Appl. No.: 811,190

[22] Filed: Jun. 29, 1977

[30] Foreign Application Priority Data

Jul. 13, 1976 [JP] Japan ..... 51-83380

[51] Int. Cl.[2] ..... B41J 1/20

[52] U.S. Cl. ..... 101/111; 198/847; 74/231 R

[58] Field of Search ..... 101/111, 327, 333, 368, 101/401.1; 74/231 R, 232, 237, 239; 132/358; 198/957, 847, 848, 844

[56] References Cited

U.S. PATENT DOCUMENTS

| | | | |
|---|---|---|---|
| 3,109,219 | 11/1963 | Bell et al. | 74/231 R |
| 3,418,929 | 12/1968 | Nelson | 101/111 |
| 3,665,773 | 5/1972 | Mitchell et al. | 74/231 R |
| 3,871,946 | 3/1975 | Romanski et al. | 74/232 |
| 3,911,755 | 10/1975 | Vance | 74/231 R |
| 3,944,060 | 3/1976 | Hartmann | 74/232 X |

*Primary Examiner*—Edward M. Coven

[57] ABSTRACT

An endless printing belt for a rotary rubber stamp, which comprises an endless rubber belt body having a plurality of printing letter sections on a surface thereof and a reinforcing endless belt fabric embedded in back side of said endless belt body, said endless belt fabric being woven by wefts including stainless steel fine wires disposed in parallel to one another in the lengthwise direction and warps including filamentary yarns.

5 Claims, 9 Drawing Figures

ENDLESS PRINTING BELT FOR ROTARY RUBBER STAMP

DETAILED DESCRIPTION OF THE INVENTION

This invention relates to an endless printing belt for a rotary rubber stamp. More particularly, the invention relates to an endless printing belt for use in a rotary rubber stamp which comprises a substantially reverse U-shaped frame body including a top plate and side plates connected to both ends of the top plate and each side plate having a hole substantially at a center thereof, a shaft inserted through said holes of side plates and fixed thereto, a plurality of rotary cylinders rotatably supported on said shaft, annular plates having non-skid teeth on the periphery thereof and being fixed to one end faces of the rotary cylinders, respectively, a bridge laid out between the lower ends of the side plates, and a plurality of endless printing belts, each having a plurality of printing letter sections on the surface thereof and being hung under tension around the corresponding rotary cylinder and the bridge.

The conventional endless printing belt of this type for a rotary rubber stamp comprises an endless belt body composed of a solid rubber or a porous rubber having a great number of open cells and a reinforcing fabric embedded in or bonded to the back side of the endless belt body.

In the rotary rubber stamp of this type, the rotary cylinders are rotated at the time of stamping by turning the annular plates by the hand so that desired printing letter sections of the endless printing belts are located at the lower end of the rotary stamp. At this time, since the endless printing belts receive a pulling force caused in the lengthwise direction by the rotation of the rotary cylinders, while the rotary stamp is used repeatedly for a long time, elongation of the endless belts in the lengthwise direction is set and the hanging state of the belts between the rotary cylinders and the bridge is relaxed, and finally, the endless printing belts cannot be rotated or turned with rotation of the rotary cylinders.

Further, when such rotary rubber stamp is assembled by hanging the endless printing belts on the rotary cylinders and bridge, there is a fear that the endless printing belts are damaged or broken because the reinforcing fabrics of the belts have not a sufficient proof strength (yield point) or a sufficient tensile strength.

As another known endless printing belt for a rotary rubber stamp of this type, Japanese Utility Model Publication No. 10504/52 proposes a endless printing belt comprising a rubber endless belt body and a reinforcing fine-mesh wire plate of brass embedded in the back of the endless belt body. Brass used for formation of the fine-mesh wire plate has relatively low proof strength and tensile strength and has relatively high elongation. Accordingly, this conventional endless printing belt is defective in that it is readily broken or damaged. Further, the reinforcing fine-mesh wire plate is often separated from the endless printing belt body because of a poor compatibility of brass with rubber. Therefore, such conventional endless printing belt is inferior in the durability and cannot be used for a long time.

It is a primary object of the present invention to provide an endless printing belt for a rotary rubber stamp, which has relatively high proof strength and tensile strength and relatively low elongation and which can be used for a long time without substantial fear of damage or breakage.

In accordance with the present invention, there is provided an endless printing belt for a rotary rubber stamp, which comprises an endless rubber belt body having a plurality of printing letter sections on the surface thereof and a reinforcing endless belt fabric embedded in the back side of said endless belt body, said endless belt fabric being woven by wefts including stainless steel fine wires disposed in parallel to one another in the lengthwise direction and warps including filamentary yarns.

In this endless printing belt for a rotary rubber stamp according to the present invention, each of the wefts may be a stainless steel fine wire having a filamentary yarn wound on the periphery thereof or a yarn formed by twisting a stainless steel fine wire and a filamentary yarn with each other.

In the endless printing belt according to the present invention, the wefts may have a coil-like shape arranged in the state circulated in the lengthwise direction of the endless belt fabric.

In the endless printing belt according to the present invention, the endless belt body may be formed of a solid rubber or a porous rubber having open cells.

In the endless printing belt for a rotary rubber stamp according to the present invention, yarns of natural fibers or synthetic fibers can be used as the filamentary yarns. Parts of the filamentary yarns may be yarns of fibers of synthetic resins having a melting point same as the temperature (140° to 160° C) adopted for vulcanization of the rubber of the endless belt body, such as polyamide and polyvinyl chloride resins. If this arrangement is adopted, when the rubber is vulcanized, parts of crossing points of the warps and wefts are fusion-bonded and the compatibility of the endless belt fabric with the rubber can be improved, and therefore, fraying and separation of yarns from the cut end face of the endless printing belt can be prevented.

Embodiments of the present invention will now be described in detail by reference to the accompanying drawing, in which.

Figure 1:
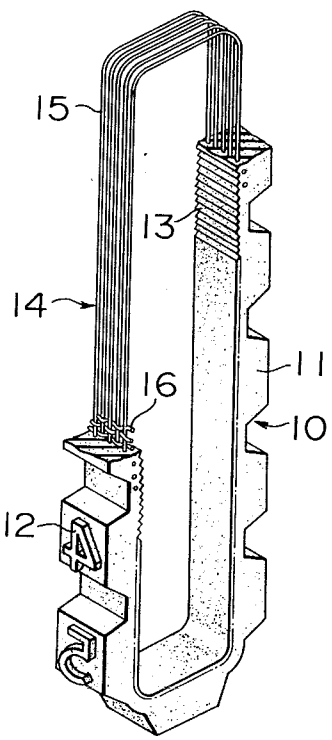
FIG. 1 is a partially cut-out perspective view illustrating a first embodiment of the endless belt for a rotary rubber stamp according to the present invention.

Referring now to FIG. 1, an endless printing belt 10 for a rotary rubber stamp comprises an endless belt body 11 having a plurality of printing letter sections 12 on the surface thereof and a non-skid roulette 13 on the back face thereof and a reinforcing endless belt fabric 14 embedded in the back side of the endless belt body 11. The endless belt fabric 14 is woven by wefts including stainless steel fine wires 15 disposed in parallel to one another in the lengthwise direction and warps including filamentary yarns 16.

Figure 2:
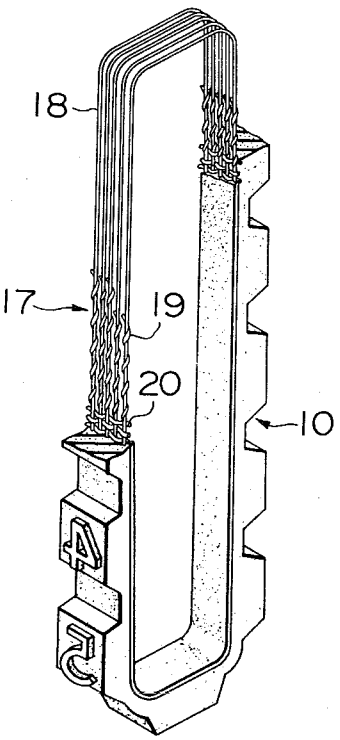
FIG. 2 is a partially cut-out perspective view illustrating a second embodiment of the present invention.

In the endless printing belt 10 for a rotary rubber stamp, which is shown in FIG. 2, an endless belt fabric 17 is woven by wefts including stainless steel fine wires 18 on which filamentary yarns 19 are wound and warps including filamentary yarns 20. In this endless belt fabric, the entanglement between the wefts and warps is enhanced, and the strength of the printing belt is further improved.

Figure 3:
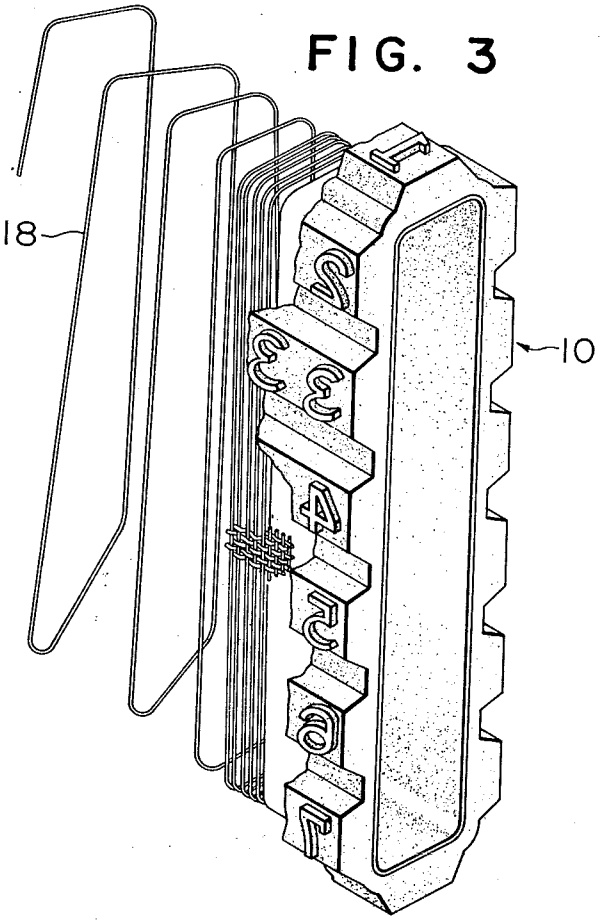
FIG. 3 is a perspective view showing a coil-like stainless steel fine wire, which has been taken out from the endless belt body of the second embodiment for convenience of illustration.

In the endless belt fabric, the stainless steel fine wires 18 may have a coil-like shape and be arranged in the state circulated in the lengthwise direction of the endless belt fabric as shown in FIG. 3.

Figure 4:
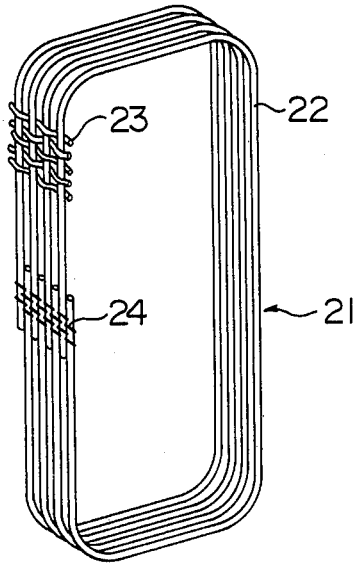
FIG. 4 is a perspective view showing another embodiment of the endless belt fabric.

Further, the endless belt fabric may be formed by sewing and bonding both the ends of a sheet-like woven fabric composed of wefts 22 and warps 23 to each other by suitable means, for example, clamps 24, as shown in FIG. 4.

Figure 5:
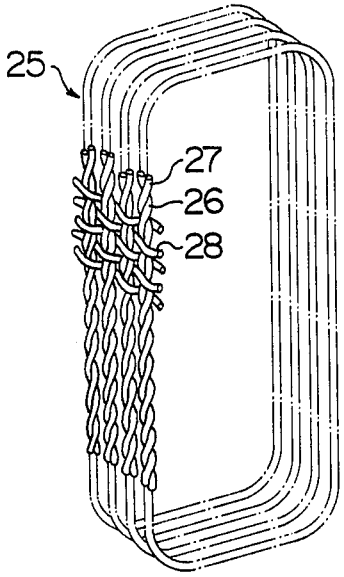
FIG. 5 is a perspective view showing still another embodiment of the endless belt fabric.

An endless belt fabric 25 shown in FIG. 5, is formed by performing weaving by using wefts formed by twisting stainless steel fine wires 26 and filamentary yarns 27 with one another and wefts composed of filamentary yarns 28.

Results of the comparative tests made on the endless printing belt according to the present invention and the conventional endless printing belt are shown in Table 1.

Table 1

| | | Endless Belt 1 of Present Invention (shown in FIG. 1) | Endless Belt 2 of Present Invention (shown in FIG. 5) |
|---|---|---|---|
| Size of Sample Piece Tested | | 94 mm × 2 mm | 94 mm × 2 mm |
| Wefts | Material | fine wires of stainless steel SUS 316 specified by Japanese Industrial Standards | combined yarns formed by twisting fine wires of stainless SUS 316 having a diameter of 0.05mm and cotton double yarns of count No.120 |
| | Thickness | 0.05 mm in diameter | |
| | Number | 76 per inch | 76 per inch |
| Warps | Material | cotton double yarn | same as in endless belt 1 |
| | Thickness | count No. 42 | |
| | Number | 178 per inch | |
| Tensile Strength | | 8.33 Kg | 8.52 Kg |
| Elongation after 36 Hours' Application of Load of 1 Kg | | 1.66 mm | 1.62 mm |
| | | Endless Belt 3 of Present Invention | Conventional Endless Belt |
| Size of Sample Piece Tested | | 94 mm × 2 mm | 94 mm × 2 mm |
| Wefts | Material | combined yarns used as wefts in endless belt 2 and cotton double yarns of count No. 120 | cotton double yarns of count No. 42 |
| | Number | 76 per inch of combined yarns and 76 per inch of cotton double yarns woven in parallel to one another | 76 per inch |
| Warps | Material | same as in endless belt 1 | same as in endless belt 1 |
| | Thickness | " | " |
| | Number | " | " |
| Tensile Strength | | 10.3 Kg | 4.57 Kg |
| Elongation after 36 hours' Application of Load of 1 Kg | | 1.56 mm | 3.00 mm |

Stainless steel SUS 316 specified by Japanese Industrial Standards has a composition of 0.08% of C and below, 1.00% of Si and below, 2.00% of Mn and below, 0.040% of P and below, 0.030% of S and below, 10.00 to 14.00% of Ni, 16.00 to 18.00% of Cr and 2.00 to 3.00% of Mo, and is characterized by a proof strength (yield point) of at least 21 kg/mm$^2$, a tensile strength of at least 53 kg/mm$^2$ and an elongation of 40%.

Count No. 42 of the cotton double yarn corresponds to a unit of 42 km/kg.

Since the elongation is very low even when the endless printing belt is stretched, if the endless printing belt of the present invention is applied to a rotary rubber stamp, a stretching state can always be maintained around the rotary cylinder and the bridge. Further, since the endless printing belt of the present invention has very high proof strength and tensile strength, it is hardly damaged or broken and it can be used stably for a long time.

Stainless steel fine wires embedded in the endless printing belt are not corroded by sulfur, a plasticizer or carbon incorporated in the rubber of the endless belt body. Further, when the endless belt body is formed of a porous rubber, the stainless steel fine wires are not corroded by powdery sodium chloride and blowing agent used for formation of the porous rubber.

Although the endless belt fabric of the endless printing belt of the present invention includes stainless steel fine wires, which are an inorganic material, since they are woven together with filamentary yarns, the reinforcing endless belt fabric shows a good compatibility with the rubber of the endless belt body and separation or peeling of the endless belt fabric is not caused to occur.

Figure 6:
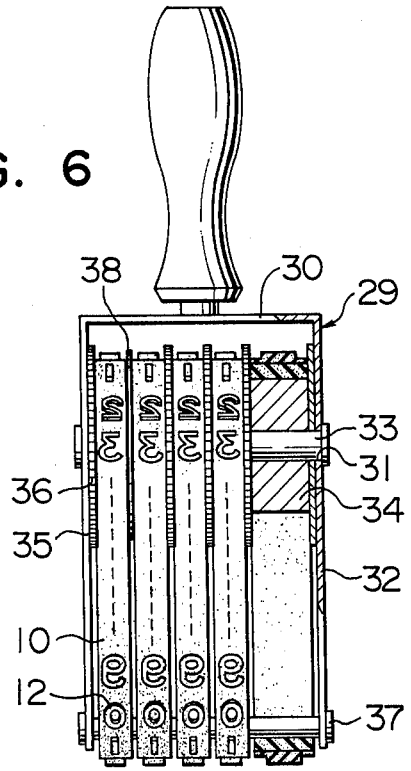
FIG. 6 is a partially longitudinally sectional front view of an embodiment of a rotary rubber stamp to which the endless printing belt of the present invention is applied.

The endless printing belt according to the present invention is applied to a rotary rubber stamp, for example, as shown in FIG. 6. The rotary rubber stamp shown in FIG. 6 comprises a reverse U-shaped frame 29 including a top plate 30 and side plates 32 connected to both the ends of the top plate 30 and each side plate having holes 31 substantially at the center thereof, a shaft 33 inserted into the holes 31 of the side plates 32 and attached thereto, a plurality of rotary cylinders 34 rotatably supported on said shaft 33, annular plates 36 fixed to one end faces of the rotary cylinders, respectively, and having non-skid teeth 36 on the periphery thereof, a bridge 37 laid out between the lower ends of the side plates 32, and a plurality of endless printing belts 10, each having a plurality of printing letter sections 12 on the surface thereof and being hung under tension around the corresponding rotary cylinder 34 and the bridge 37, an annular separator 38 being interposed between the two adjacent endless printing belts 10 that are arranged adjacently directly without the interposing annular plate 35.

In the present invention, it is important that the rubber endless belt body and the reinforcing endless belt fabric embedded in the back side of the rubber endless belt body must be tightly and strongly bonded to and integrated with each other.

Especially when the rubber endless belt body is composed of a porous rubber, in order to further enhance the strength of bonding between the two members, the following method may be adopted according to need.

More specifically, the rubber endless belt body is formed by incorporating in the starting rubber suitable amounts of a vulcanizing agent, a filler and an easily water-soluble salt powder which is not decomposed or gasified at a vulcanization temperature and kneading the mixture. Then, a lowly viscous paste formed by incorporating in a volatile solvent suitable amounts of the starting rubber, the vulcanizing agent, the filler and the easily water-soluble salt powder which is not decomposed or gasified at a vulcanization temperature and blending the mixture under agitation is coated on the reinforcing endless belt fabric and the coated fabric is dried. Then, vulcanization is conducted under heating in a mold in which the rubber endless belt body and the reinforcing endless belt fabric are laminated under compression, whereby the two endless belt members are integrated with each other. Then, the integrated assembly is taken out from molds and the easily water-soluble belt powder added to both the endless belt members is removed by water washing.

In the so prepared endless printing belt, the bonding of the two endless belt members can be remarkably enhanced, and open cells continuous from the back face to the front face are formed in the endless printing belt 10.

Figure 7:
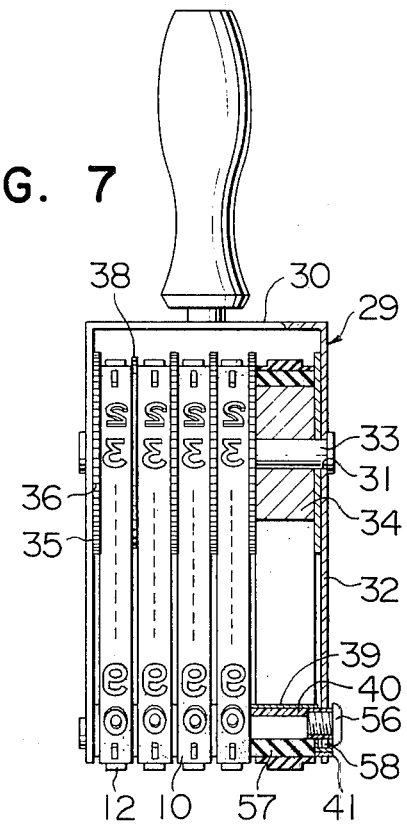
FIG. 7 is a partially longitudinally sectional front view of another embodiment of a rotary rubber stamp in which the endless printing rubber belts have open cells continuous from the back face to the front face and an ink is supplied to the printing letter sections from the back face of this endless printing belt.
Figure 8:
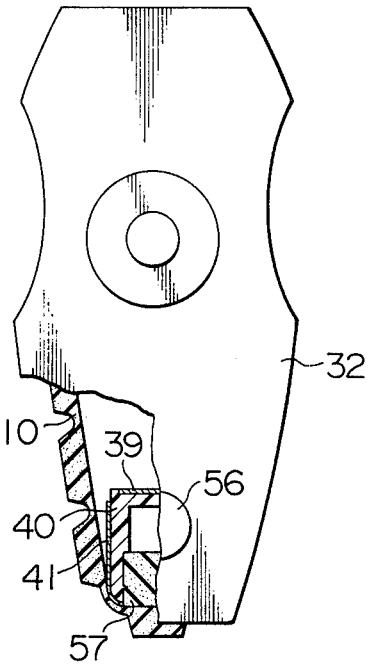
FIG. 8 is a partially longitudinally sectional side view illustrating the rotary rubber stamp shown in FIG. 7.
Figure 9:
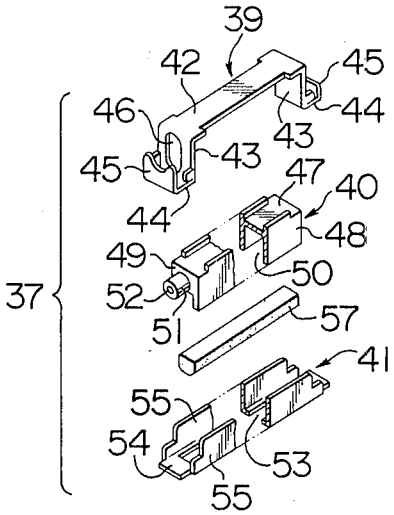
FIG. 9 is a take-out perspective view showing the girder of FIG. 7.

In the embodiment illustrated in FIG. 7, the bridge 37 comprises a girder 39, an ink absorber-containing casing 40 and a bottom lid 41. The girder 39 includes a long plate 42, downwardly bent portions 43 extended from respective sides of the plate 42, outwardly bent portions 44 extended from the bent portions 43 and upwardly bent portions 45 extended from the outwardly bent portions 44. An opening 46 is formed on one of the downwardly bent portions 43.

The casing 40 includes a top wall 47, two downwardly extended side walls 48 and two downwardly extended end walls 49. Therefore, the casing 40 has a downwardly faced opening 50. Further, the casing 40 has an ink-supplying short cylinder 51 mounted on one end wall 49. A screw hole 52 is formed on the cylinder 51.

The bottom lid 41 includes a long plate 54 having a long opening 53 and an upwardly extended side wall 55.

The girder 39 is disposed so that the upwardly bent portion 44 is fitted in a notch 58 formed on the lower end of the side plate 32 of the frame 29, and the casing 40 is disposed so that the short cylinder 51 passes through the opening 46 of the girder 39 and the notch 58 of the side plate 32. In this state, a screw 56 is fitted in the screw hole 52 and the casing 40 is fixed.

An ink absorber 57 is formed of a porous material and an ink is stored in the state absorbed in the ink absorber 57. This ink absorber is contained in the casing 40.

The bottom lid 41 is disposed so that the side wall 55 thereof covers the casing 40, and the lower face of the ink absorber 57 is slightly projected from a long hole 53 of the lid 41.

The printing belt 10 having open cells is disposed so that the back face thereof falls in contact with the surface of the ink absorber 57. Accordingly, the ink stored in the ink absorber 57 is supplied to the surface of the printing letter section 12 from the back face of the printing belt 10 through the open cells.

What is claimed is:

1. An endless printing belt for a rotary rubber stamp, which comprises an endless rubber belt body having a plurality of printing letter sections on a surface thereof and a reinforcing endless belt fabric embedded in the back side of said endless rubber belt body, said endless belt fabric being woven by wefts including stainless steel fine wires disposed in parallel to one another in the lengthwise direction of said belt and filamentary warps comprising yarns composed of a synthetic resin having a melting temperature substantially the same as the vulcanization temperature of the rubber of said endless rubber belt body.

2. An endless printing belt for a rotary rubber stamp according to claim 1, wherein each of the wefts includes one formed by winding the filamentary yarn around said stainless steel fine wires.

3. An endless printing belt for a rotary rubber stamp according to claim 1, wherein each of the wefts includes one formed by twisting the stainless steel fine wire and the filamentary yarn about each other.

4. An endless printing belt for a rotary rubber stamp according to claim 1 wherein the wefts have a coil-like shape and are positioned in the lengthwise direction of said endless belt fabric.

5. An endless printing belt for a rotary rubber stamp according to claim 1 wherein the endless rubber belt body is formed of porous rubber cells.

* * * * *